United States Patent [19]

McJunkin

[11] Patent Number: 4,856,124

[45] Date of Patent: Aug. 15, 1989

[54] SWIMMING POOL STEP GUARD

[76] Inventor: Claude L. McJunkin, 12184 111th La. North, Largo, Fla. 34648

[21] Appl. No.: 153,415

[22] Filed: Feb. 8, 1988

[51] Int. Cl.[4] ..... E04H 3/18

[52] U.S. Cl. ..... 4/496; 4/661

[58] Field of Search ..... 4/496, 504, 506, 505, 4/511, 577, 593, 579–576, 559, 561, 661; 292/339, 338; 52/182; 248/354.1, 354.5, 351; 441/136; 15/257 R

[56] References Cited

U.S. PATENT DOCUMENTS

| | | | |
|---|---|---|---|
| 3,583,743 | 6/1971 | Newell | 248/354.1 |
| 3,870,268 | 3/1975 | Larkin | 248/354.1 |
| 4,019,765 | 4/1977 | Nichola | 248/354 |
| 4,429,429 | 2/1984 | Altschul | 15/50 R |
| 4,576,354 | 3/1986 | Blessing, Sr. | 248/351 |
| 4,676,536 | 6/1987 | Arbic et al. | 248/359.1 |
| 4,695,028 | 9/1987 | Hunter | 248/354.1 |

FOREIGN PATENT DOCUMENTS

| | | | |
|---|---|---|---|
| 1304203 | 1/1973 | United Kingdom | 4/506 |

*Primary Examiner*—Henry J. Recla
*Assistant Examiner*—Edward C. Donovan
*Attorney, Agent, or Firm*—Harold D. Shall

[57] ABSTRACT

A swimming pool step guard having resilient means to adjust the length thereof is engaged at its upper end by a pool edge adjacent the pool stair well and engages the bottom of the pool at its lower end to thereby block entrance into the stairwell of a pool sweeper.

1 Claim, 5 Drawing Sheets

SWIMMING POOL STEP GUARD

BACKGROUND OF THE INVENTION

1. Field of the Invention

This invention relates to swimming pool step guards and more particularly to such a step guard for use in conjunction with an automatic pool sweeper to prevent the sweeper from entering and becoming entrapped in the stairwell of a swimming pool when using a pool sweeper of the general type of the well known brand called a "Kreepy Krauly" (TM).

2. Background of the Invention

The pool sweepers of the general type such as the one known as "Kreepy Krauly" work on a self propelled principal and advance across the floor of the pool and also advance along the side walls of the swimming pool. When the sweep comes to the built in stairwell of the conventional swimming pool, it enters the stairwell and becomes entrapped therein and merely bumps back and forth without exiting from the stairwell to clean the remainder of the pool.

3. Objects of the Invention

It is therefore an object of this invention to provide a step guard for use with a pool with a stair well when the pool sweep is in use and is removable at such times as the pool sweep is not in use.

4. Description of the Prior Art

There is no known prior art applicable to this invention to the inventor's knowledge.

SUMMARY OF THE INVENTION

A two piece rod, having resilient length control means is provided which includes means to adjust its length so that the top of the rod will fit snugly under the lip of the pool adjacent to the steps and the lower end will fit snugly against the bottom of the pool approximately six inches from the side wall of the pool and immediately adjacent to the stair well. A third piece of the rod extends laterally therefrom into engagement with a wall of the pool along side of the steps approximately six to eight inches from the bottom of the two piece rod (this distance being adjustable as required by the step height) to keep the sweep from going between the lower end of the two piece rod and the pool wall.

DETAILED DESCRIPTION OF A PREFERRED EMBODIMENT

Figure 1:
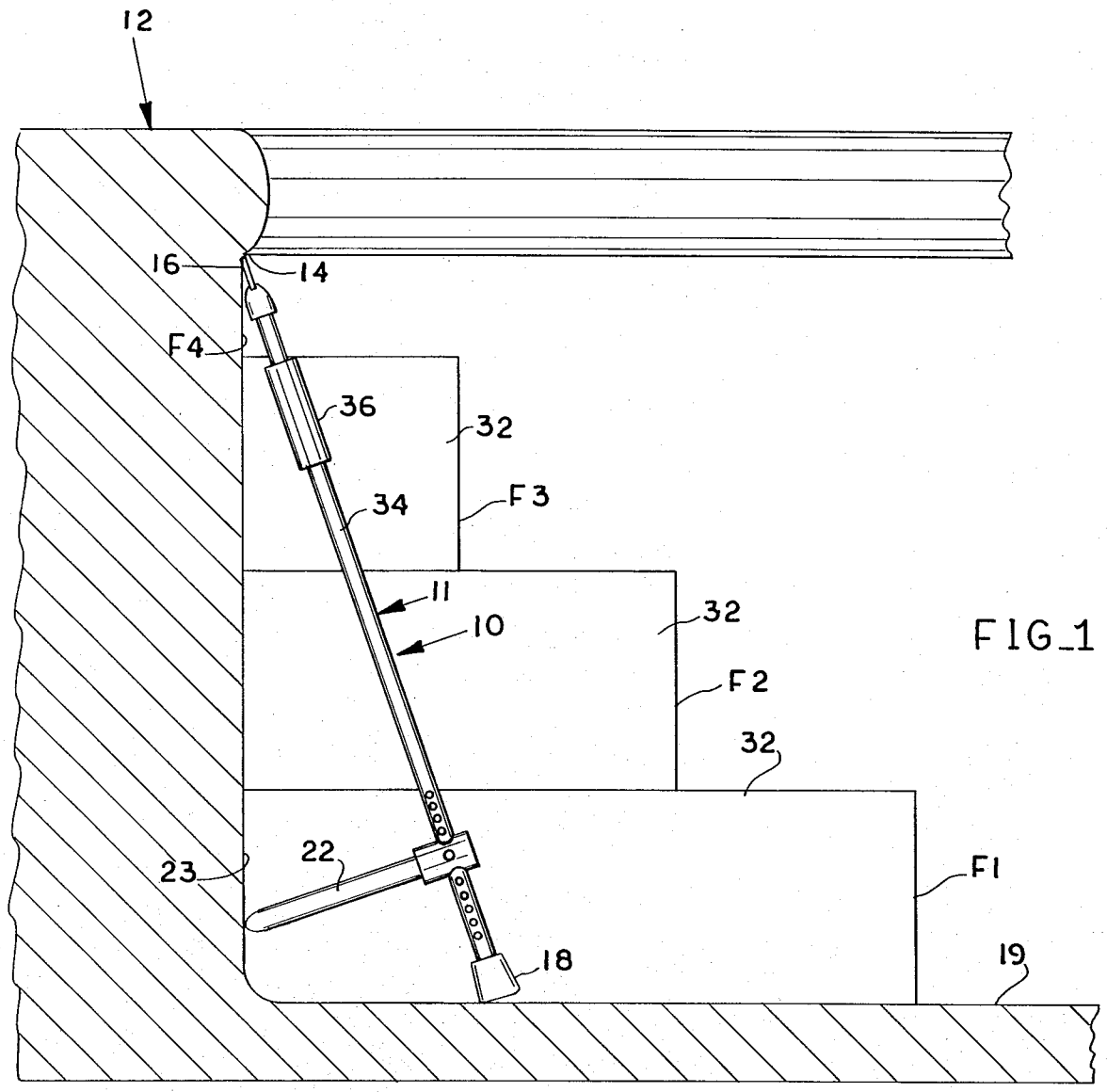
FIG. 1 is a front elevational view of the step guard positioned along one side of the steps of the stairwell; the swimming pool wall and floor being shown in section.
Figure 2:
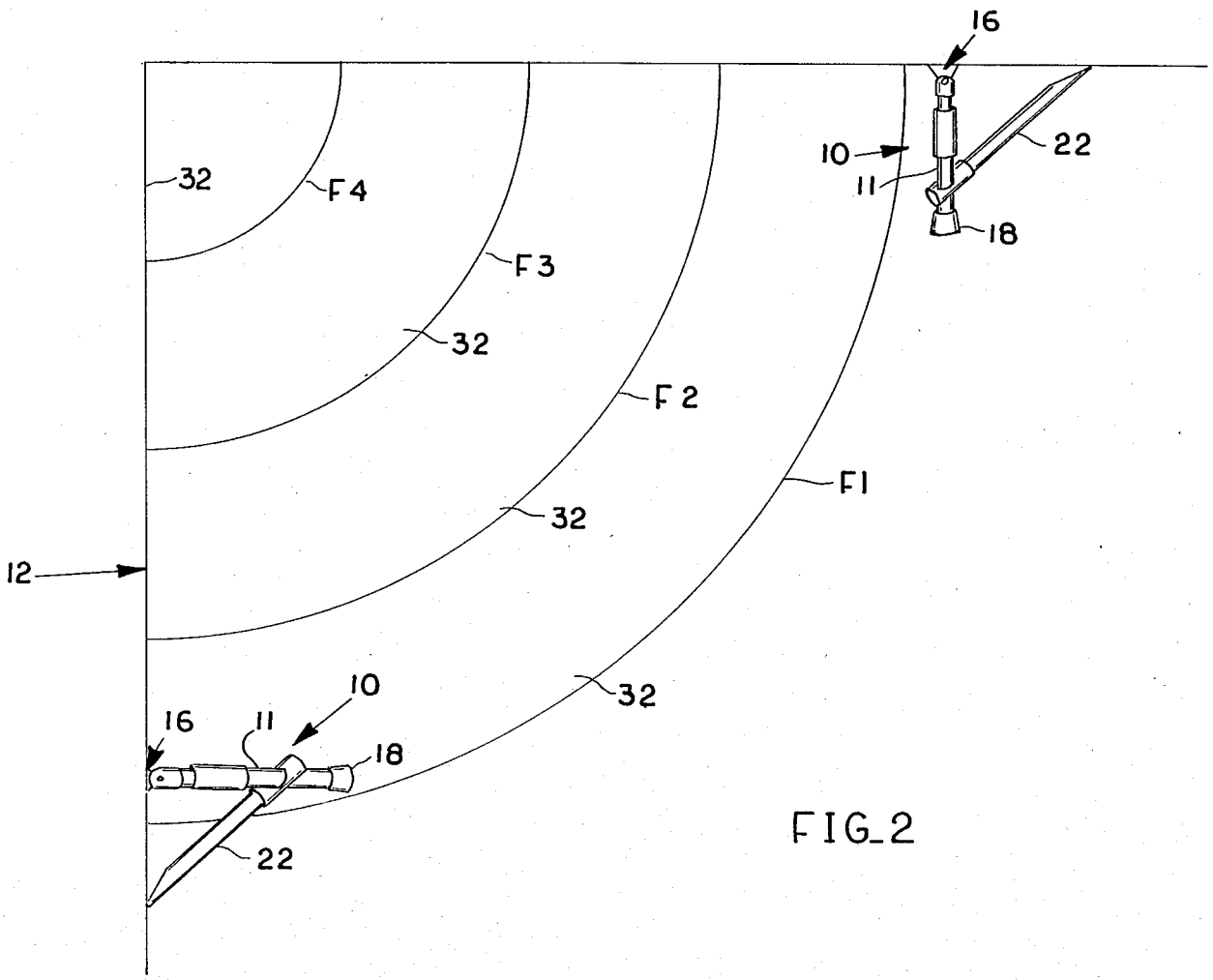
FIG. 2 is a plan view of a stairwell showing a separate step guard positioned and blocking each end of the stairwell.
Figure 4:
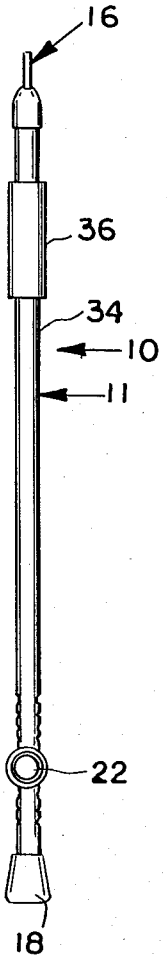
FIG. 4 is a side elevational view of the step guard of FIG. 3.
Figure 3:
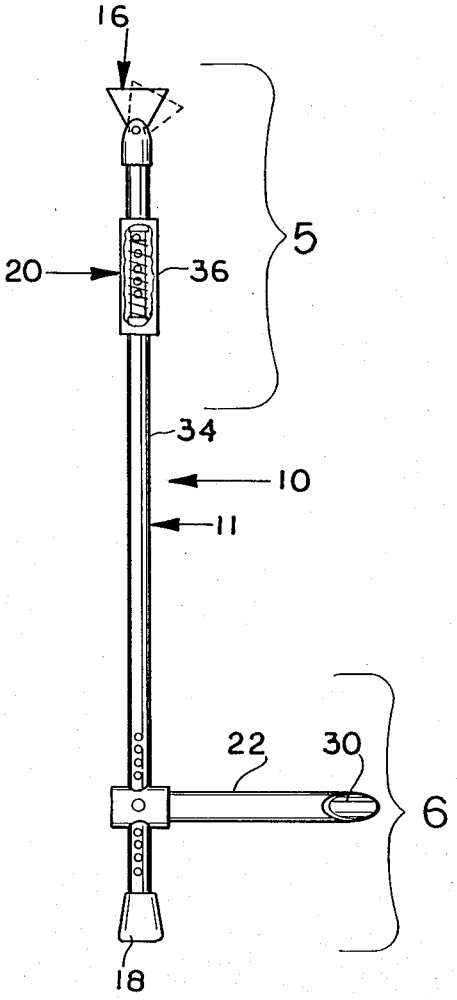
FIG. 3 is a rear elevational view of the step guard of FIG. 1 with portions broken away for added clarity.
Figure 5:
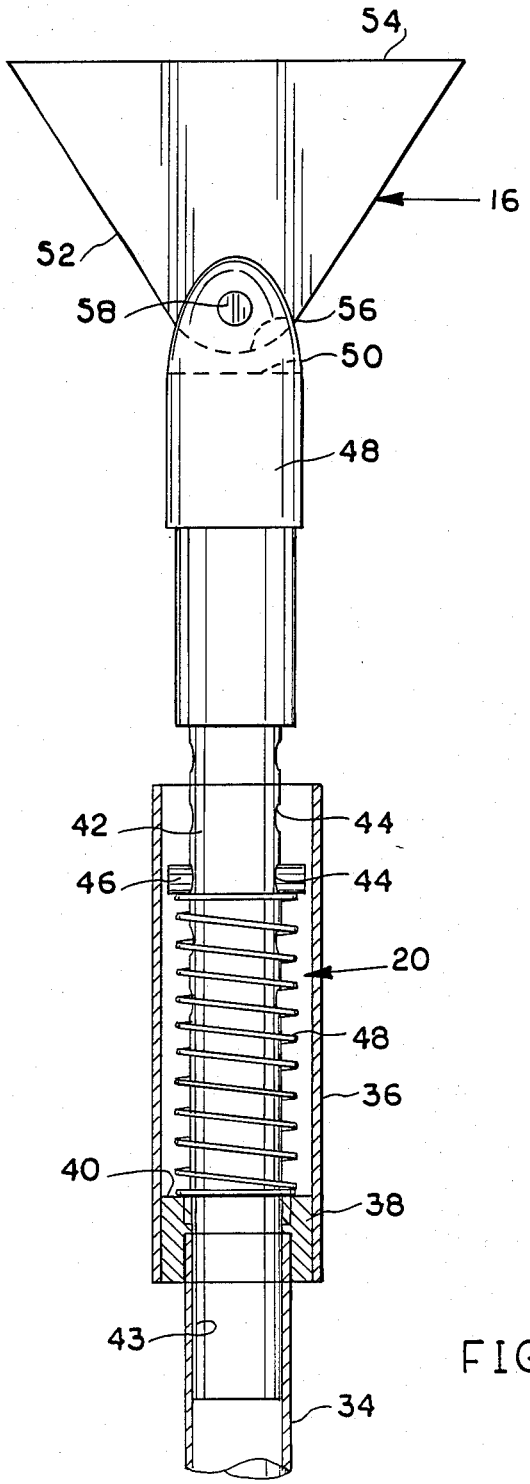
FIG. 5 is an enlarged view of that portion of FIG. 3 shown by the numeral 5 with portions shown in section for added clarity.

Referring to FIG. 1, a step guard 10 is shown in position in the pool 12 wedged between the lower inner edge 14 of the pool lip at its upper end 16 and with its lower end 18 wedged against the pool bottom 19 thereby to firmly secure the step guard in place. The step guard's lower end 18 is an elastomeric cap and in itself could be used to provide an elastic wedging action of the step guard 10; however, a more secure elastic device has been provided, shown generally at 20 in FIGS. 3 and 5, to insure a long lifed wedging action; such elastic device 20 being more fully described hereinafter.

Figure 6:
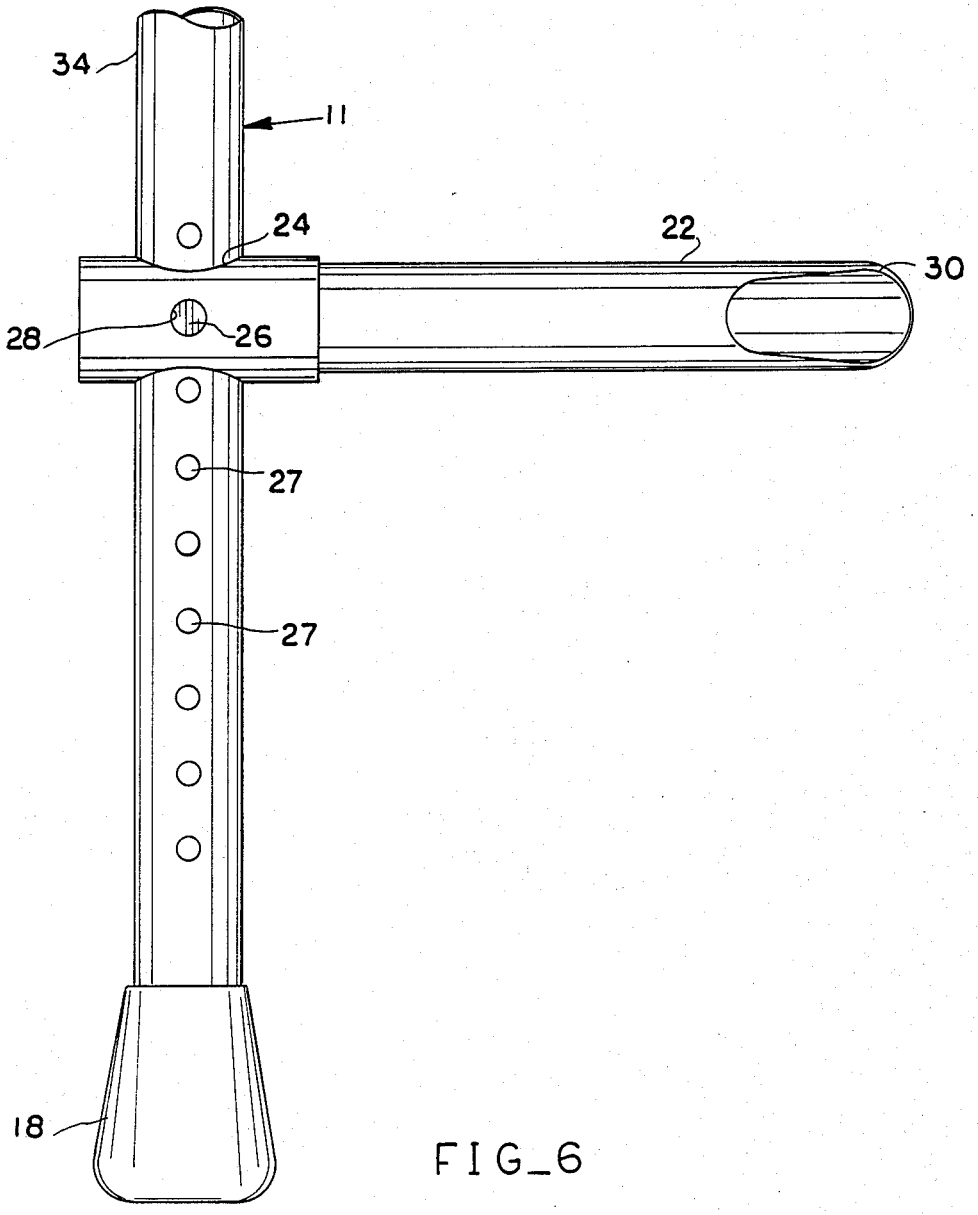
FIG. 6 is an enlarged view of that portion of FIG. 3 shown by the numeral 6.

Referring to FIGS. 1, 2, 3 and 4, a laterally extending PVC rod 22 extends from the PVC vertical position 11 of the guard 10 and engages the side wall 23 of the pool 12. More particularly, as clearly seen in FIG. 6, the laterally extending portion 22 has a transverse opening 24 therein which telescopically receives the vertical portion 11 and is slidable therealong. A plurality of openings 27 are formed in the vertical portion 11 which openings are adapted to receive a pin 26 which fits in a transverse opening 28 in the lateral rod 22 and into a registering opening 27 in the vertical portion 11 and secures the relative position thereof. The step guard 10 is preferably made from various diameter hollow polyvinyl chloride (PVC) tubing throughout its length, so that the openings 27 only extend through the outer wall of the guard 10.

The outer end 30 of the rod 22 is formed at a taper so that the rod 22 lies against the pool wall and deflect the pool sweeper from the pool wall when it comes in contact therewith. The pool sweeper (not shown) has no steering mechanism and when it contacts a solid object it changes direction of its path. Thus upon contact with the step guard 10 anywhere along its length, the sweeper will change direction and move away from the steps 32. The pool sweep moves along the floor and walls of the pool and changes direction when it bumps something or when it comes to the top of the water line and loses its suction, at which time it falls down.

The lower tubular portion 34 is of hollow PVC tubing and has an upper slightly larger tubular PVC portion 36 secured thereto by an intermediate collar 38, which collar is bonded to the upper portion 36 and pressed on to the lower portion 34, however it could be bonded to both portions. The collar 38 forms an upper shoulder 40.

Received in the portions 34 and 36 is the lower end 42 of the upper end 16 of the step guard 10. The very lower end 43 of end 16 is dimensioned so as to be slidingly telescoped in the upper end of the tubular portion 34; however it should be noted that portion 42 and 43 are of the same external diameter. The lower end 42 of the upper end 16 has a plurality spaced transversely extending openings 44 extending therethrough and in a selected one of the openings 44 a transverse abutting pin 46 is pressed. This is a light press fit so that the pin 46 can be removed and slipped into the selected opening 44 to form a top abutment; between which abutment and the shoulder 40 is a coiled spring 48, which spring when compressed between the pin 46 and the shoulder 40 biases the portions 34 and 42 apart thereby to attempt to lengthen the elastic device 20 to provide a tight fit between the upper end 16 and the pool inner edge 14 and between the lower end 18 and the pool bottom. The pin 46, can be adjusted into the opening 44 to give the degree of compression to the coiled spring 48 which is desired.

Extending upwardly from the lower end 42 of the upper end 16 is a slotted portion 48 which has a transversely extending slot 50 therein. Received in the slot 50 is an abutting member 52 which has a flat abutting outer end 54 and an inner end 56 which is received in the slot 50. A pin 58 pivotly secures the abutting member 52 to the slotted portion 48 so that the upper end of the step guard 10 can pivot to securely abut the inner edge 14 of the pool 12. If the pool has no inner edge 14 for abutment purposes, an abutment block can be cemented to the edge of the pool to satisfy this requirement.

As the pool sweeps moves across the floor of the pool and comes to the stairwell, it will bump the face F1 of the lowest step 32 and be deflected from entering the stairwell and continue on its path elsewhere. Accordingly, the face F1 of the bottom step protects the front of the stairwell and for that reason the lower end 18 of the step guard 10 can actually be placed upon the top of the lowest step 32 and be operative. When the pool sweep comes to the stairwell along the side wall above the face F1 of the lowest step, were it not for the step guard, the pool sweep could enter the stairwell and become entrapped therein by bouncing around within the confines of the stairwell. The front faces F2, F3 and F4 cannot protect the stairwell the way that face F1 does because these surfaces are within the stairwell.

Although a specific embodiment of the invention has been disclosed, it will be understood by those skilled in the art that changes may be made therein without departing from the spirit and scope of the invention.

What is claimed is:

1. A swimming pool step guard for use in a pool having a stairwell with a horizontal surface of the pool being adjacent the stairwell and the pool having an abutting downwardly facing inner edge formed thereon overlying a portion of the horizontal surface, said step guard comprising an upper and a lower tubular portion with one of said portions being telescopically received in the other end of said portions, an abutting shoulder means formed on the other of said portions, an abutting pin means adjustably carried by one of said portions, a coiled compression spring disposed between said shoulder means and said pin means for biasing said tubular portions axially of each other thereby urging the assembly of said tubular portions to become longer, an abutting member pivotally secured to the upper end of said upper tubular portion and projecting inwardly therefrom for engagement with the downwardly facing inner edge of the pool, an elastomeric cap secured over the lower end of said lower tubular portion for engagement with the horizontal surface of the pool, and a transverse member secured transversely to said lower portion, said transverse member having a tapered outer end for abutting the adjacent side wall of the pool.

* * * * *